US011035319B2

(12) United States Patent
Berner et al.

(10) Patent No.: US 11,035,319 B2
(45) Date of Patent: Jun. 15, 2021

(54) SEALING ASSEMBLY COMPRISING A CYLINDER HEAD, A CYLINDER HEAD GASKET AND A CRANKCASE

(71) Applicant: MAN Truck & Bus AG, Munich (DE)

(72) Inventors: Armin Berner, Herrieden (DE); Thomas Leitel, Schwabach (DE); Walter Schibalsky, Nuremberg (DE)

(73) Assignee: MAN Truck & Bus AG, Munich (DE)

( * ) Notice: Subject to any disclaimer, the term of this patent is extended or adjusted under 35 U.S.C. 154(b) by 80 days.

(21) Appl. No.: 15/892,856

(22) Filed: Feb. 9, 2018

(65) Prior Publication Data

US 2018/0230938 A1 Aug. 16, 2018

(30) Foreign Application Priority Data

Feb. 10, 2017 (DE) ..... 10 2017 001 255.5

(51) Int. Cl.

| | |
|---|---|
| ***F02F 11/00*** | (2006.01) |
| ***F02B 77/08*** | (2006.01) |
| ***F01M 13/00*** | (2006.01) |
| ***F02F 1/24*** | (2006.01) |
| ***F01M 11/02*** | (2006.01) |

(52) U.S. Cl.

CPC ..... *F02F 11/002* (2013.01); *F01M 13/00* (2013.01); *F02B 77/088* (2013.01); *F02F 1/24* (2013.01); *F01M 2011/023* (2013.01)

(58) Field of Classification Search

CPC ..... F02F 11/002; F02F 1/24; F02B 77/088; F01M 13/00; F01M 2011/023

See application file for complete search history.

(56) References Cited

U.S. PATENT DOCUMENTS

2005/0206091 A1* 9/2005 Detmann ..... F16J 15/0818 277/594
2006/0249116 A1 11/2006 Liebert
2015/0377114 A1* 12/2015 Matsumoto ..... F02F 1/14 123/41.44

FOREIGN PATENT DOCUMENTS

CN 1611816 A 5/2005
CN 204253862 U 4/2015
DE 1907682 A1 * 8/1970 ..... F16J 15/0818

(Continued)

OTHER PUBLICATIONS

European Office Action issued in European Patent Application No. 18154457.8 dated Jul. 13, 2020, 3 pages. English translation not available.

(Continued)

*Primary Examiner* — Jacob M Amick
*Assistant Examiner* — Charles J Brauch
(74) *Attorney, Agent, or Firm* — Weber Rosselli & Cannon LLP

(57) ABSTRACT

The present disclosure relates to an internal combustion engine for a motor vehicle. The internal combustion engine has a cylinder head, a crankcase and a cylinder head gasket. The cylinder head, the cylinder head gasket and the crankcase form a sealing region for sealing at least one combustion chamber. A first recess is arranged within the sealing region and at a distance from the at least one combustion chamber. A first leakage gas passage extends from the first recess to a first surface exposed to the environment of the internal combustion engine or to a ventilation passage of the internal combustion engine.

21 Claims, 8 Drawing Sheets

(56) References Cited

FOREIGN PATENT DOCUMENTS

| | | | | | |
|---|---|---|---|---|---|
| DE | 1907682 | A1 | | 8/1970 | |
| DE | 1907682 | B2 | | 8/1976 | |
| DE | 4337758 | C1 | | 1/1995 | |
| DE | 19534962 | A1 | | 3/1997 | |
| DE | 102004010472 | A1 | | 9/2005 | |
| DE | 102004054815 | A1 | | 5/2006 | |
| DE | 102010023812 | A1 | | 12/2011 | |
| DE | 102010023812 | A1 | * | 12/2011 | ..... F01P 11/0285 |
| DE | 102012109646 | A1 | | 4/2014 | |
| EP | 1561977 | A1 | | 8/2005 | |
| EP | 2543834 | A1 | | 1/2013 | |
| GB | 2049808 | A | | 12/1980 | |
| GB | 2049808 | B | | 8/1983 | |
| JP | H0313412 | U | | 2/1991 | |
| WO | 9619655 | A1 | | 6/1996 | |

OTHER PUBLICATIONS

First Office Action issued in Chinese Application No. 201810140178.4 dated Mar. 3, 2021 with English translation, 22 pages.
First Office Action issued in Chinese Application No. 201810140178.4 dated Mar. 3, 2021 with English translation.

* cited by examiner

SEALING ASSEMBLY COMPRISING A CYLINDER HEAD, A CYLINDER HEAD GASKET AND A CRANKCASE

TECHNICAL FIELD

The present disclosure relates to an internal combustion engine for a motor vehicle, to a cylinder head gasket for an internal combustion engine, to a cylinder head for an internal combustion engine and to a crankcase for an internal combustion engine. The present disclosure furthermore relates to a motor vehicle, in particular a commercial vehicle, and to a method for discharging leakage gas coming from a combustion chamber of an internal combustion engine.

BACKGROUND

In internal combustion engines subject to high loads, sealing between the cylinder head and the crankcase is performed by a cylinder head gasket. The cylinder head gasket is often designed in such a way that it extends over all the cylinders. The crankcase and the cylinder head are clamped together by means of a plurality of high-strength screws distributed over the cylinder in order to reliably exert the required pressure on the gasket at the combustion pressures which arise (e.g. up to 300 bar and above). The external dimensions of a cylinder head gasket are dimensioned in such a way that no gap is formed between the cylinder head and the crankcase. Owing to the high screw forces, the cylinder head, the cylinder head gasket and the crankcase are pressed together firmly not only in the region of the combustion chambers but also in the outer regions of the sealing assembly. Owing to the high compression forces, there is good metallic sealing here too. In cases in which the engine has replaceable cylinder liners, the gasket is pressed against the cylinder liner installed in the crankcase. In the ideal case, the sealing assembly remains unobtrusive over the entire service life of the engine, and neither combustion gases nor other media which are exchanged between the cylinder head and the crankcase escape to a technically significant extent.

The prior art includes cylinder head gaskets which have grooves for various reasons. Cylinder head gaskets of this kind are disclosed in DE 43 37 758 C1, DE 10 2004 054 815 A1 and DE 195 34 962 A1, for example.

Cylinder head gaskets in internal combustion engines are typically flat gaskets, which can leak to a small extent, i.e. do not provide 100-percent sealing. Owing to the high ignition pressures in the combustion chamber, a certain small proportion of the combustion gases can escape during the ignition of the fuel/air mixture under certain preconditions. This can be tolerated up to a certain limit. A gasket of this kind is nevertheless referred to as "technically leaktight."

In the course of the life of an engine, the sealing assembly can settle and/or wear, resulting in an increase in leakage of combustion gases ("creeping gas"). Other faults and relaxation can likewise lead to an increase in leakage.

If leakage gas escapes during ignition, this enters between the sealing surfaces into the interspaces between the crankcase and the cylinder head gasket or the cylinder head gasket and the cylinder head. The good metallic sealing in the inner and outer regions of the sealing assembly can prevent the leakage gas from getting back into the combustion chamber or penetrating further outwards. Consequently, the leakage gas may accumulate within the sealing assembly in regions and cavities (e.g. recessed core hole caps, holes etc.) around the combustion chambers. In the course of time, an excess pressure can arise, and this can damage the sealing assembly or other engine components. In this context, typical patterns of damage can lead to damage to cap screws, snapping off of screw heads and core hole caps being pressed in, as a result of which coolant enters the interspaces and spreads out in the sealing region and there can be permanent deformations of the cylinder head gasket by the incompressible cooling medium. Moreover, elastomers in the outer sealing region and beyond can be damaged, an excess pressure can arise in the coolant, the entire sealing surface can be damaged and the head assembly can hammer on the cylinder liner and damage the crankcase, for example.

SUMMARY

Starting from the problems described above, which can occur in connection with the escape of leakage gas from the combustion chamber, it is an object of the present disclosure to improve the sealing assembly comprising a cylinder head, a cylinder head gasket and a crankcase.

The internal combustion engine for a motor vehicle, in particular a commercial vehicle, has a cylinder head, in particular a single-cylinder cylinder head or a multi-cylinder cylinder head. The internal combustion engine furthermore has a crankcase, a cylinder head gasket, in particular a single-cylinder cylinder head gasket or a multi-cylinder cylinder head gasket. The cylinder head gasket is arranged between the cylinder head and the crankcase. The cylinder head, the cylinder head gasket and the crankcase form a sealing region for sealing at least one combustion chamber of the internal combustion engine. The internal combustion engine furthermore has a first recess. The first recess is arranged within the sealing region and at a distance from the at least one combustion chamber. The first recess is, in particular, a screw hole or a casting core hole, which is preferably closed by means of a core hole closure cap. The internal combustion engine furthermore additionally has a first leakage gas passage. The first leakage gas passage extends from the first recess to a first surface exposed to the environment of the internal combustion engine. As an alternative or in addition, the first leakage gas passage extends from the first recess to a ventilation passage of the internal combustion engine. The first leakage gas passage can be designed, in particular, as a depression.

The provision according to the present disclosure of the first leakage gas passage makes it possible for leakage gas that has accumulated in the first recess to be discharged from the first recess. Consequently, an excess pressure due to the accumulating leakage gas, which can damage the sealing assembly, is prevented from forming in the first recess. The sealing surfaces of the cylinder head, of the crankcase and of the cylinder head gasket form the sealing region. In particular, the leakage gas can be passed into an environment of the internal combustion engine. For this purpose, the leakage gas passage can open into a surface exposed to the environment of the internal combustion engine. The exposed surface can be an outer peripheral surface or an exposed end face, for example. Via the leakage gas passage, the leakage gas can also be discharged into an environment of the internal combustion engine via the intermediate stage of a ventilation system of the internal combustion engine. For this purpose, the leakage gas passage can open into a ventilation passage of the internal combustion engine. In particular, the leakage gas is diverted from screw holes and in the region of closed casting core holes since these regions have proven to be particularly critical regions.

According to one embodiment, the internal combustion engine can furthermore have a second recess. The second recess is arranged within the sealing region and at a distance from the at least one combustion chamber. The second recess is, in particular, a screw hole or a casting core hole, which is preferably closed by means of a core hole closure cap. In addition, the internal combustion engine can have a second leakage gas passage. The second leakage gas passage extends from the second recess to the first surface exposed to the environment of the internal combustion engine, to a second surface exposed to the environment of the internal combustion engine, to the first recess, to the first leakage gas passage and/or to the ventilation passage. In particular, the second leakage gas passage is designed as a depression. The provision of a second leakage gas passage makes it possible to divert leakage gas from another recess. Depending on the installation space situation, the leakage gas can be discharged directly into the environment through the second leakage gas passage, for example, e.g. via the first or second exposed surface. Alternatively or in addition, the leakage gas can be discharged into the environment through the second leakage gas passage via the intermediate stage of the first recess, the first leakage gas passage or the ventilation passage.

It is advantageous if the first recess and/or the second recess is/are provided in a sealing surface of the cylinder head, in a sealing surface of the crankcase and/or in a sealing surface of the cylinder head gasket. As an alternative or in addition, the first leakage gas passage and/or the second leakage gas passage is/are provided in a sealing surface of the cylinder head, in a sealing surface of the crankcase and/or in a sealing surface of the cylinder head gasket. For example, a first and a second recess as well as a first and a second leakage gas passage can all be provided in the same component (cylinder head, cylinder head gasket, crankcase). However, it is also possible for a leakage gas passage to extend through a plurality of components, e.g. the cylinder head gasket and the crankcase. It is furthermore possible for the recess and the associated leakage gas passage to be provided in different components. Thus, for example, a leakage gas can be diverted from a recess which extends only in the cylinder head or the crankcase, through a leakage gas passage which extends in the cylinder head gasket and is open to the recess. One example of a recess of this kind is a casting core hole closed by means of a core hole closure cap for closing a water core of the cylinder head or of the crankcase.

In particular, the first leakage gas passage and/or the second leakage gas passage can be designed as a groove, a channel or a slot. This allows a multiplicity of possible manufacturing techniques for the leakage gas passages, which can be manufactured according to requirements and possibilities.

In one illustrative embodiment, the first and/or the second surface exposed to the environment of the internal combustion engine is/are an outer peripheral surface of the cylinder head, an outer peripheral surface of the crankcase and/or an outer peripheral surface of the cylinder head gasket. Thus, ventilation of the leakage gas passage or of the leakage gas passages can be made possible in a simple manner. As an alternative or in addition, the ventilation passage can form a section of a cylinder head ventilation system and/or a section of a crank chamber ventilation system.

In one illustrative embodiment the at least one combustion chamber has two adjacent combustion chambers. The first recess and/or the second recess is/are arranged between the adjacent combustion chambers. It has been found that, in particular, the region between the combustion chambers and, in this case, especially the screw holes between the combustion chambers, is/are a critical region. By diverting the leakage gas out of this critical region, it is possible to prevent damage here.

According to another variant embodiment, the first leakage gas passage and/or the second leakage gas passage is/are formed by a forming method, in particular a compressive forming method, preferably by stamping. As an alternative or in addition, the first leakage gas passage and/or the second leakage gas passage is/are formed by a machining method, in particular a milling method.

The present disclosure also relates to a cylinder head gasket of an internal combustion engine. In particular, the cylinder head gasket is a single-cylinder cylinder head gasket or multi-cylinder cylinder head gasket. The cylinder head gasket has at least one combustion chamber opening, an outer peripheral surface and a first sealing surface for sealing with respect to a crankcase or a cylinder head. The cylinder head gasket furthermore has a first recess, which is arranged within the first sealing surface at a distance from the at least one combustion chamber opening. In particular, the first recess is a through hole, preferably a screw hole. The cylinder head gasket furthermore has a first leakage gas passage. The first leakage gas passage extends from the first recess to the outer peripheral surface and/or to a ventilation opening of the cylinder head gasket. In particular, the first leakage gas passage is designed as a depression which extends in the first sealing surface.

The provision according to the present disclosure of the first leakage gas passage makes it possible for leakage gas that has accumulated in the first recess to be discharged from the first recess. Consequently, an excess pressure due to accumulating leakage gas, which can damage the sealing assembly, is prevented from forming in the first recess. The leakage gas is passed out of the first recess into an environment of the internal combustion engine. For this purpose, the leakage gas passage opens into an outer peripheral surface of the cylinder head gasket, for example.

The cylinder head gasket furthermore preferably has a second recess, which is arranged within the first sealing surface and/or a second sealing surface at a distance from the combustion chamber opening. The second sealing surface is opposite the first sealing surface. The second recess is, in particular, a through hole, preferably a screw hole. The cylinder head gasket furthermore has a second leakage gas passage, which extends from the second recess to the outer peripheral surface, to the first recess, to a ventilation opening of the cylinder head gasket and/or to the first leakage gas passage. The second leakage gas passage is designed, in particular, as a depression which extends in the first sealing surface or the second sealing surface.

In one embodiment, the at least one combustion chamber opening has two adjacent combustion chamber openings. The first recess and/or the second recess is/are arranged between the two adjacent combustion chamber openings. As already explained above, it has been found that the region between the combustion chambers and thus the combustion chamber openings, in particular, and, in this case, in particular, the screw holes, is/are a critical region. By diverting the leakage gas out of this critical region, it is possible to prevent damage here.

In one illustrative embodiment, the cylinder head gasket is a single-ply cylinder head gasket, e.g. made from a metal. As an alternative, the cylinder head gasket can be a multi-ply cylinder head gasket, which is formed, for example, from a plurality of plies, e.g. metal plies, laid one on top of the other. The first leakage gas passage and/or the second leakage gas passage can preferably extend in an outer ply of the multi-ply cylinder head gasket. This allows simple manufacture of the leakage gas passages.

The present disclosure furthermore relates to a cylinder head, in particular a single-cylinder cylinder head or a multi-cylinder cylinder head for an internal combustion engine. The cylinder head has at least one combustion chamber surface for delimiting at least one combustion chamber, an outer peripheral surface and a sealing surface for sealing with respect to a cylinder head gasket. The cylinder head furthermore has a first recess, which is arranged within the sealing surface at a distance from the at least one combustion chamber surface. In particular, the first recess is a screw hole or a casting core hole, which is preferably closed by means of a core hole closure cap. The cylinder head furthermore has a first leakage gas passage, which extends from the first recess to the outer peripheral surface and/or to a ventilation passage of the cylinder head. In particular, the first leakage gas passage is designed as a depression which extends in the sealing surface.

Once again, the provision according to the present disclosure of the first leakage gas passage allows leakage gas that has accumulated in the first recess to be diverted out of the first recess.

It is advantageous if the at least one combustion chamber surface has two adjacent combustion chamber surfaces for two adjacent combustion chambers. The first recess and/or a second recess is/are arranged between the two adjacent combustion chamber surfaces. The second recess is arranged within the sealing surface at a distance from the at least one combustion chamber surface and is, in particular, a screw hole or a casting core hole, which is preferably closed by means of a core hole closure cap. The cylinder head has a second leakage gas passage, which extends from the second recess to the outer peripheral surface, to the first recess, to the first leakage gas passage and/or to the ventilation passage. In particular, the second leakage gas passage is designed as a depression which extends in the sealing surface.

The present disclosure furthermore relates to a crankcase for an internal combustion engine. The crankcase has at least one combustion chamber, an outer peripheral surface and a sealing surface for sealing with respect to a cylinder head gasket. The crankcase furthermore has a first recess, which is arranged within the sealing surface at a distance from the at least one combustion chamber. In particular, the first recess is a screw hole or a casting core hole, which is preferably closed by means of a core hole closure cap. In addition, the crankcase has a first leakage gas passage, which extends from the first recess to the outer peripheral surface and/or to a ventilation passage of the crankcase. In particular, the first leakage gas passage is designed as a depression which extends in the sealing surface.

As with the above-described internal combustion engine, the above-described cylinder head gasket and the above-described cylinder head, the provision according to the present disclosure of the first leakage gas passage allows leakage gas that has accumulated in the first recess to be discharged from the first recess.

Attention is drawn to the fact that the internal combustion engine, the cylinder head gasket, the cylinder head and/or the crankcase as disclosed herein and, in particular, in accordance with one of the above embodiments can have a plurality of first recesses, a plurality of first leakage gas passages, a plurality of second recesses and/or a plurality of second leakage gas passages.

In addition, the present disclosure relates to a motor vehicle, in particular a commercial vehicle, having an internal combustion engine, a cylinder head gasket, a cylinder head or a crankcase as disclosed herein.

The present disclosure furthermore relates to a method for discharging leakage gas, in particular creeping gas coming from a combustion chamber of an internal combustion engine, from a sealing region between a cylinder head, a cylinder head gasket and a crankcase of the internal combustion engine for sealing the combustion chamber. The method comprises the step of collecting the leakage gas in at least one recess formed within the sealing region. In particular, the recess is a screw hole or a closed casting core hole. The recess is at a distance from the combustion chamber of the internal combustion engine. The method furthermore comprises the step of guided discharge of the leakage gas out of the at least one recess outside the sealing region into an environment of the internal combustion engine and/or into a ventilation system of the internal combustion engine. In particular, the ventilation system is a crankcase ventilation system and/or a cylinder head ventilation system.

BRIEF DESCRIPTION OF THE FIGURES

The above-described preferred embodiments and features of the present disclosure can be combined in any desired manner. Further details and advantages of the present disclosure are described below with reference to the attached drawings, in which.

DETAILED DESCRIPTION

Figure 1:
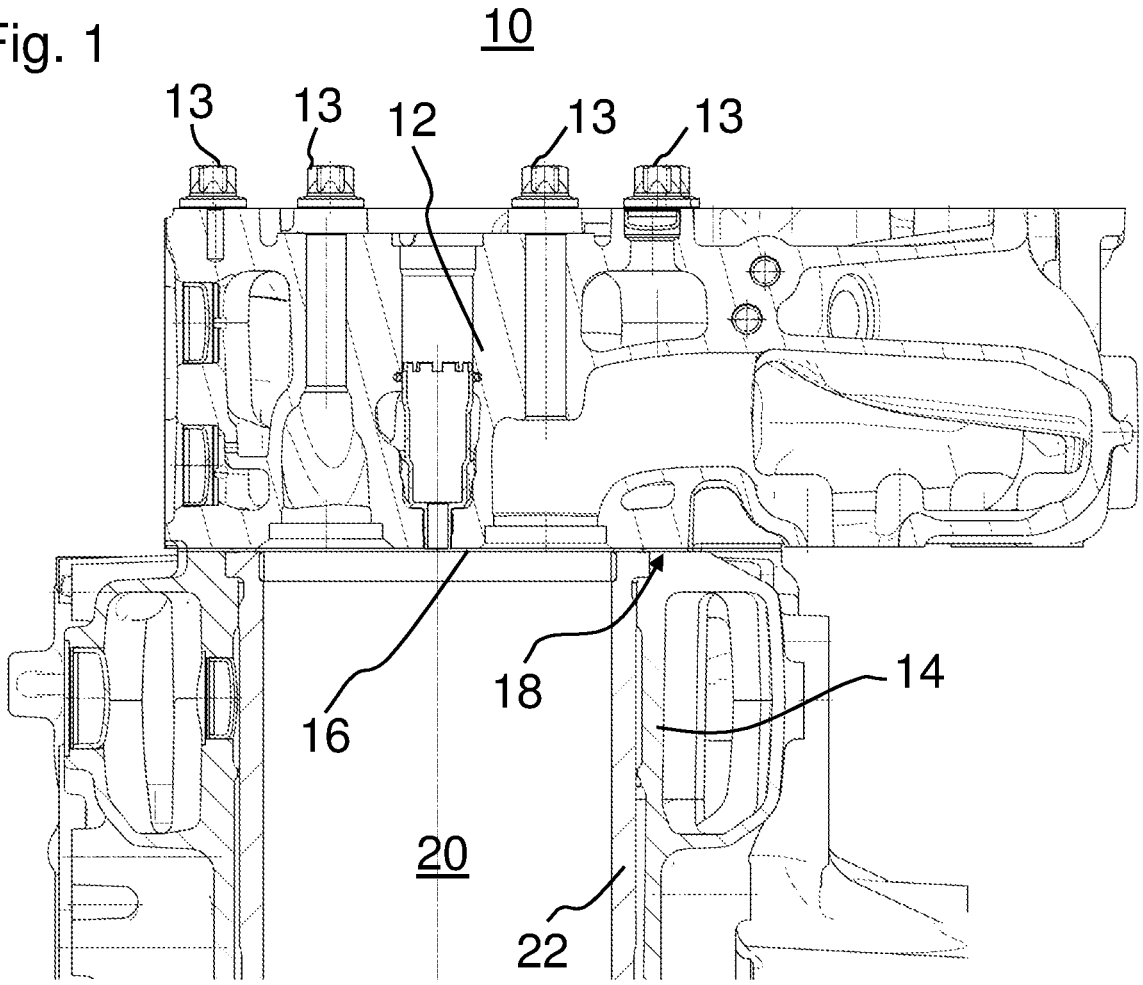
FIG. 1 shows a section through a region of an internal combustion engine.

FIG. 1 shows a section through a region of an internal combustion engine 10. The internal combustion engine 10 has a cylinder head 12, a crankcase 14 and a cylinder head gasket 16. The cylinder head gasket 16 is arranged between the cylinder head 12 and the crankcase 16. The cylinder head 12 is attached to the crankcase 14 by means of a plurality of screws 13, wherein the cylinder head gasket 16 is trapped. As a result, the cylinder head 12, the crankcase 14 and the cylinder head gasket 16 form a sealing region 18 for sealing the combustion chamber 20. The internal combustion engine 10 can have a plurality of combustion chambers 20. In some embodiments, the internal combustion engine 10 can furthermore have a cylinder liner 22, which is inserted in a cylinder bore of the crankcase 14, as illustrated in FIG. 1.

Figure 2:
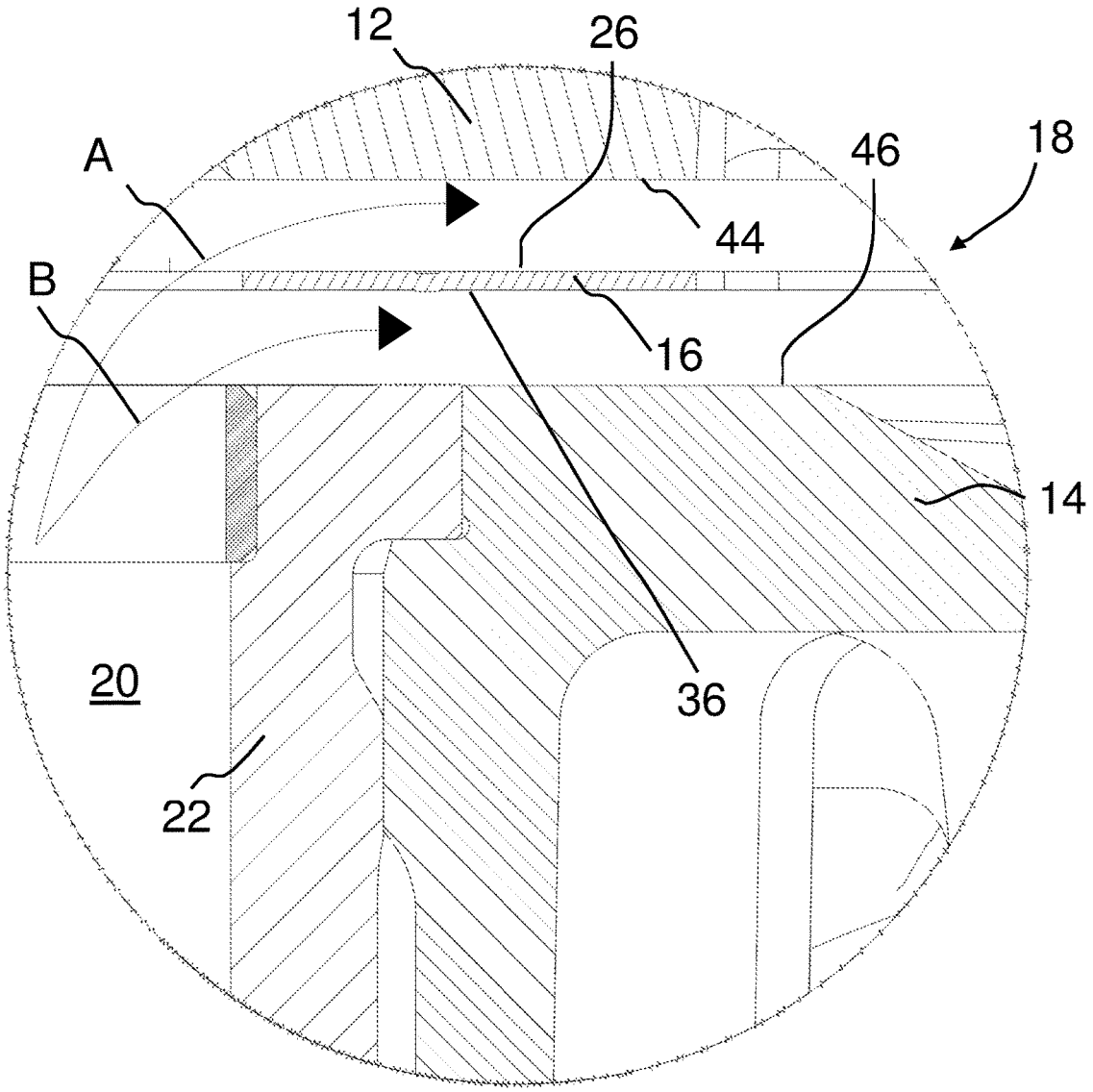
FIG. 2 shows a schematic view of a sealing assembly between a cylinder head, a cylinder head gasket and a crankcase.

FIG. 2 shows how leakage gases from the combustion chamber 20 can get into interspaces in the sealing region 18. Attention is drawn to the fact that FIG. 2 is purely schematic and that distances between the cylinder head 12 and the cylinder head gasket 16 and between the cylinder head gasket 16 and the crankcase 18 are shown in order to describe the leakage more clearly. In fact, a sealing surface 44 of the cylinder head 12 rests on a first sealing surface 26 of the cylinder head gasket 16 in the installed state. Likewise, a second sealing surface 36 of the cylinder head gasket 16 which is opposite the first sealing surface 26 rests on a sealing surface 46 of the crankcase 18.

Owing to the high combustion and ignition pressures, leakage gas can escape from the combustion chamber 20 between sealing surfaces 44 and 26 and between sealing surfaces 36 and 46 during the operation of the internal combustion engine 10. This is indicated in FIG. 2 by arrows A and B. As explained in detail below, this leakage gas, which is also referred to as creeping gas, can accumulate in recesses in the sealing region 18 (the sealing surfaces 26, 36, 44, 46).

An illustrative cylinder head gasket 16, which allows guided discharge of the leakage gas, is described below with reference to FIGS. 3A to 3C.

In particular, the leakage gas can accumulate in a first recess 28A and a second recess 29A of the cylinder head gasket 16. The recesses 28A, 29A are provided as screw holes, through which the cap screws 13 (see FIG. 1) can be guided to screw them into the crankcase 14 (see likewise FIG. 1). The recesses 28A, 29A are arranged between and at a distance from two adjacent combustion chamber openings 24 of the cylinder head gasket 16.

Extending around the combustion chamber openings 24 of the cylinder head gasket 16 is a first sealing surface 26 for sealing with respect to a cylinder head 12 or a crankcase 14 (see FIGS. 1 and 2). The recesses 28A, 29A are arranged within the first sealing surface 26, i.e. are surrounded by the first sealing surface 26. A first leakage gas passage 30A and a second leakage gas passage 38A extend in the first sealing surface 26.

The first leakage gas passage 30A extends between the first recess 28A and an outer peripheral surface 32A. Leakage gas from the combustion chamber 20 (see FIGS. 1 and 2) which accumulates in the first recess 28A can be discharged into the environment of the cylinder head gasket (of the internal combustion engine) through the first leakage gas passage 30A. The formation of an excess pressure in the first recess 28A is thus prevented, thereby enabling possible damage to be prevented.

The second leakage gas passage 38A extends between the first recess 28A and the second recess 29A. Leakage gas from the combustion chamber 20 (see FIGS. 1 and 2) which accumulates in the second recess 29A can be discharged through the second leakage gas passage 38A, the first recess 28A and the first leakage gas passage 30A.

In other embodiments, it is alternatively or additionally possible, for example, for the second leakage gas passage 38A to open into the first leakage gas passage 30A or into a ventilation passage of the internal combustion engine 10, which can extend as a ventilation opening (not shown) through the cylinder head gasket 16. It should furthermore be taken into account that, especially in the case of multi-cylinder cylinder head gaskets, like the cylinder head gasket 16 illustrated in FIG. 3A, a plurality of first leakage gas passages 30A, a plurality of first recesses 28A, a plurality of second leakage gas passages 38A and/or a plurality of second recesses 29A can be provided, thus making it possible, in particular, to discharge leakage gas from recesses which are arranged between two adjacent combustion chamber openings 24. The plurality of first recesses 28A and/or the plurality of second recesses 29A is therefore preferably arranged between two adjacent combustion chamber openings 24.

Attention is furthermore drawn to the fact that there is the possibility, for example, that the first leakage gas passage 30A and/or the second leakage gas passage 38A extend/extends to a recess which is provided only in the cylinder head 12 or crankcase 14 (see FIGS. 1 and 2). The cylinder head gasket 16 is then designed in such a way that the corresponding leakage gas passage and the corresponding recess partially overlap in the assembled state.

The cylinder head gasket 16 has further screw holes 27. In some embodiments, these screw holes 27 can also be ventilated by means of one or more leakage gas passages, which open into the outer peripheral surface 32, for example.

Figure 3A:
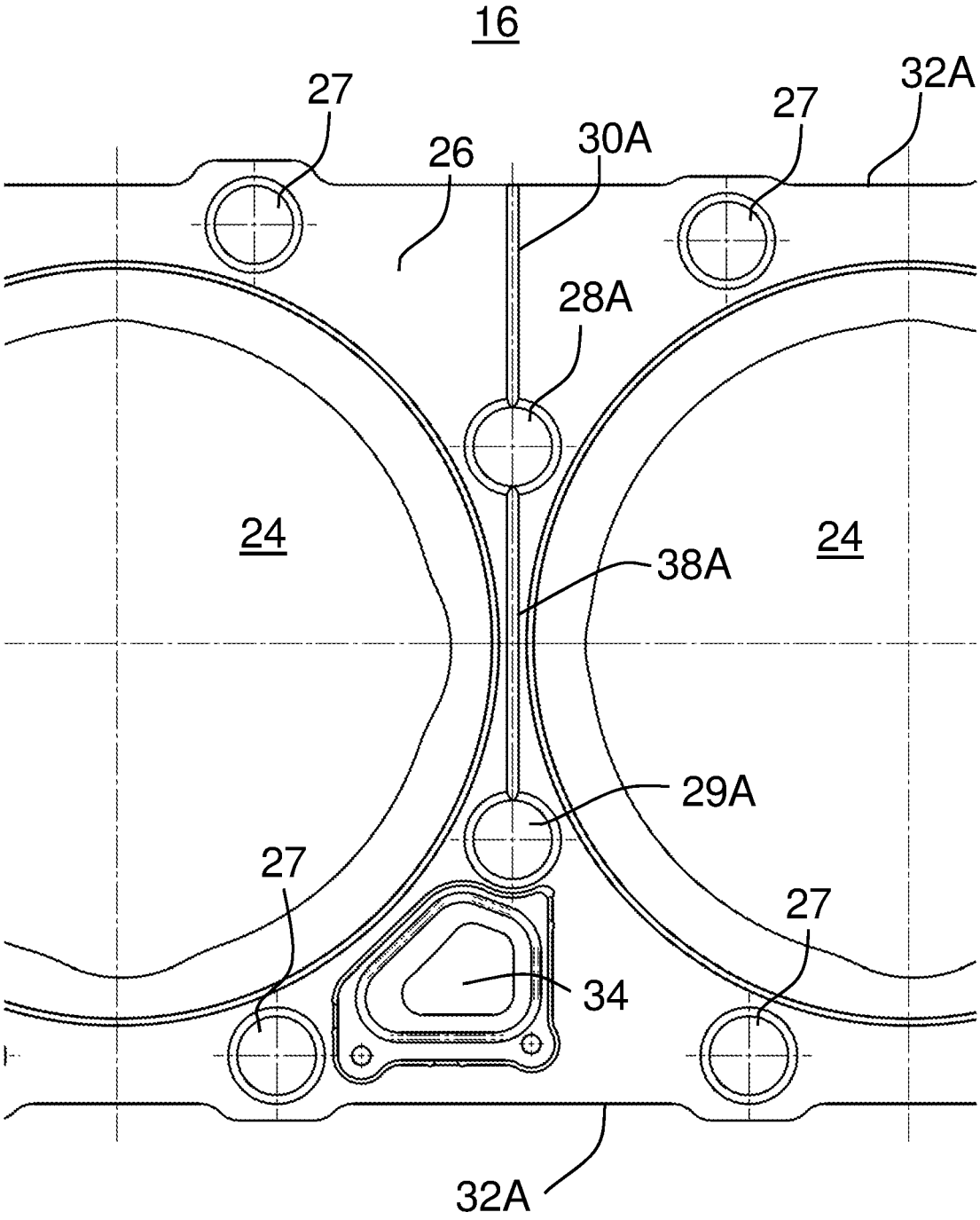
FIG. 3A shows a plan view of a region of a multi-cylinder cylinder head gasket.

The cylinder head gasket 16 from FIG. 3A furthermore has a through hole 34, which is surrounded by an elastomer. The through hole 34 is at a distance from the combustion chamber opening 24. In the installed state, the through hole 34 connects a cooling passage in the cylinder head 12 and a cooling passage in the crankcase 14. No leakage gas passage opening into the through hole 34 is provided since this would result in leakage of the coolant.

Figure 3B:
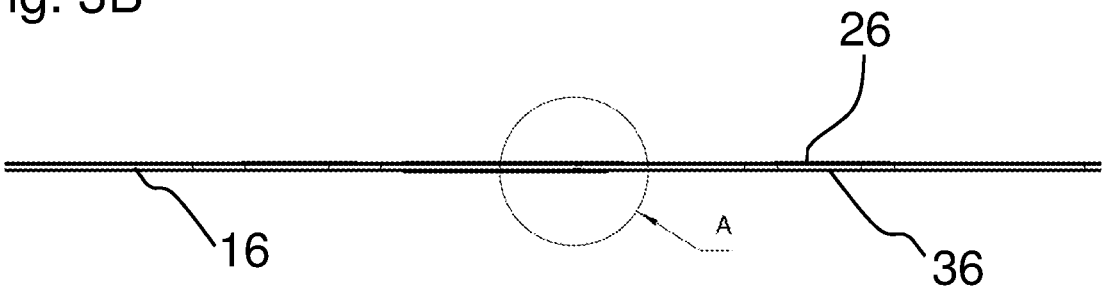
FIG. 3B shows a (longitudinal) cross section through the multi-cylinder cylinder head gasket.
Figure 3C:
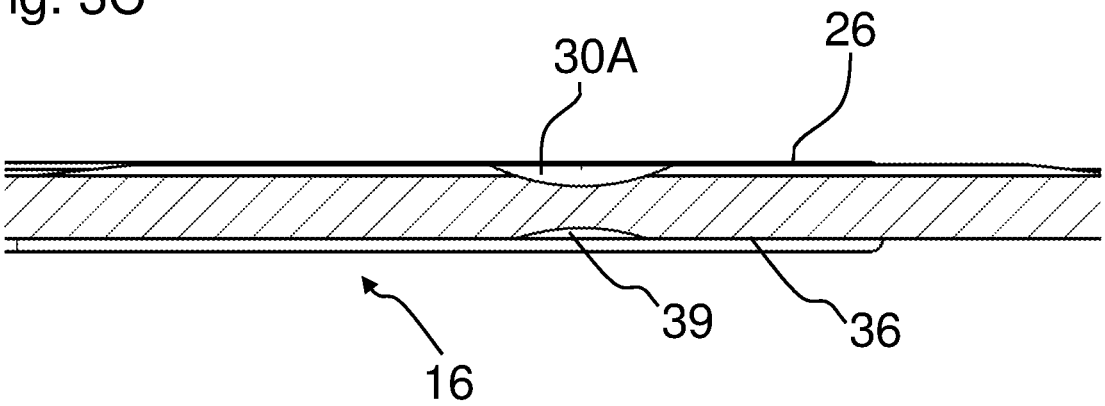
FIG. 3C shows an enlarged detail A of the cross section through the cylinder head gasket from FIG. 3B.

FIG. 3C shows a detail from FIG. 3B, which shows a longitudinal cross-sectional view of the cylinder head gasket 16. As can be seen from FIG. 3C, the first leakage gas passage 30A is designed as an elongate depression in the first sealing surface 26. Opposite the first sealing surface 26, the cylinder head gasket 16 has the second sealing surface 36. As an alternative or in addition, a leakage gas passage 39 can also extend in the second sealing surface 36 between a recess and a ventilation passage of the internal combustion engine 10 (see FIG. 1) and/or the outer peripheral surface 32A etc.

In the embodiment shown, the cylinder head gasket 16 is designed as a single-ply cylinder head gasket. In other embodiments, the cylinder head gasket 16 can have multiple plies, wherein the leakage gas passage or passages is/are preferably designed as depressions in a sealing surface of one outer ply or both outer plies.

Figure 4:
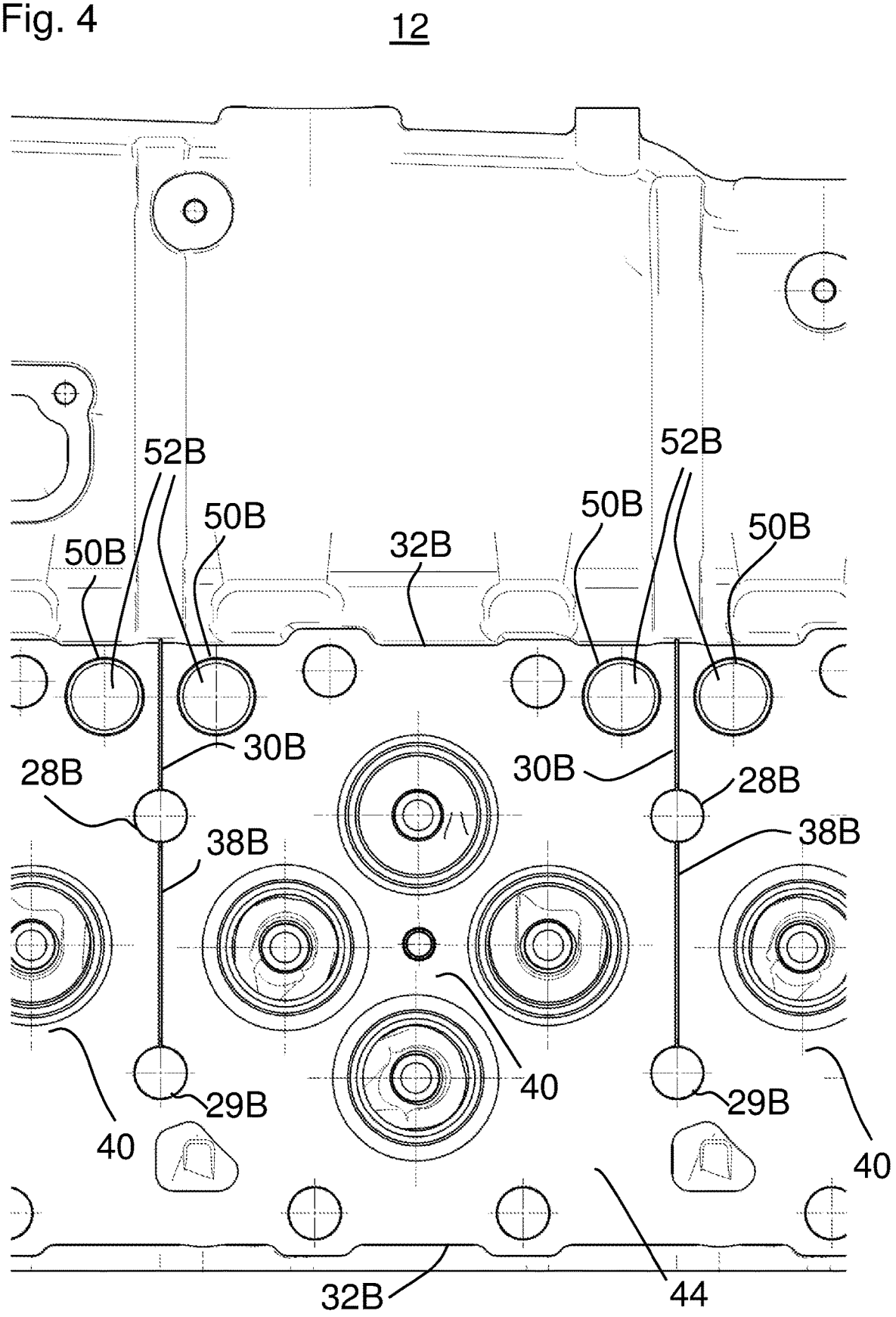
FIG. 4 shows a plan view of a region of a lower side of a multi-cylinder cylinder head.
Figure 5:
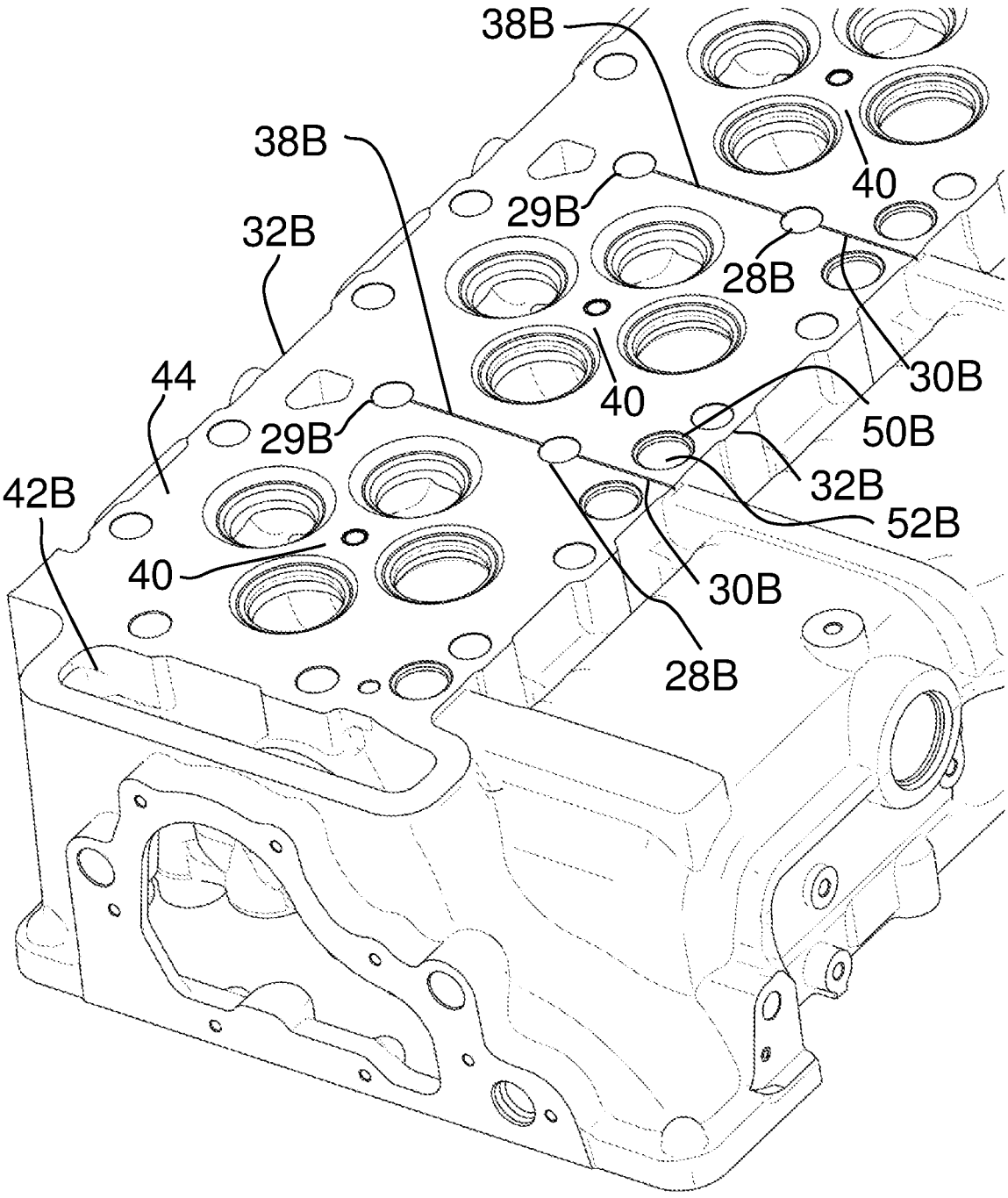
FIG. 5 shows a perspective view of a region of a lower side and of an outer periphery of a multi-cylinder cylinder head.

With reference to FIGS. 4 and 5 as well as FIGS. 6 and 7, it is explained below that leakage gas passages can also be provided in the cylinder head (cf. FIGS. 4 and 5) and/or in the crankcase (cf. FIGS. 6 and 7) in addition to or as an alternative to the cylinder head gasket (cf. FIGS. 3A-3C).

FIGS. 4 and 5 show different regions of a multi-cylinder cylinder head 12. The cylinder head 12 has the sealing surface 44 for sealing with respect to a cylinder head gasket. The sealing surface 44 surrounds a plurality of combustion chamber surfaces 40, which each serve as an upper limit of the combustion chambers 20 of the internal combustion engine 10 (see FIG. 1). Opening into the combustion chamber surfaces 40 are inlet passages and outlet passages, into which poppet valves can be inserted, for example. Fuel injectors, ignition devices etc. can likewise extend at least partially into the combustion chambers 20 from openings in the combustion chamber surfaces 40. The sealing surface 44 is delimited at the outside by an outer peripheral surface 32B.

The cylinder head 12 has a plurality of first leakage gas passages 30B. The first leakage gas passages 30B connect a plurality of first recesses 28B, which are designed as screw holes, to the outer peripheral surface 32B. Consequently, leakage gas which is in the screw holes 28B can be discharged into the environment. In addition, the cylinder head 12 has a plurality of second leakage gas passages 38B. The second leakage gas passages 38B connect a plurality of second recesses 29B, which are likewise designed as screw holes, to the plurality of first recesses 28B. Consequently, leakage gas can be passed out of the second recesses 29B into the first recesses 28B and, from there, discharged into the environment via the first leakage gas passages 30B. The recesses 28B, 29B are arranged between adjacent combustion chamber surfaces 40 since there are particularly critical regions for the accumulation of leakage gas here. The leakage gas passages 30B, 38B are designed as depressions in the sealing surface 44.

In other embodiments, the cylinder head can also be designed as a single-cylinder cylinder head. The leakage gas passages can extend in the sealing surface 44, starting from further recesses. For example, the leakage gas passages can extend from casting core holes 50B. The casting core holes 50B are closed by core closure caps 52B, with the result that a lubricant guide or coolant guide situated behind the core closure cap 52B is sealed off with respect to the outside. For discharge of the leakage gas to the environment, the leakage gas passage or passages can also extend to a ventilation passage 42B, which can form a section of a cylinder head ventilation system.

Figure 6:
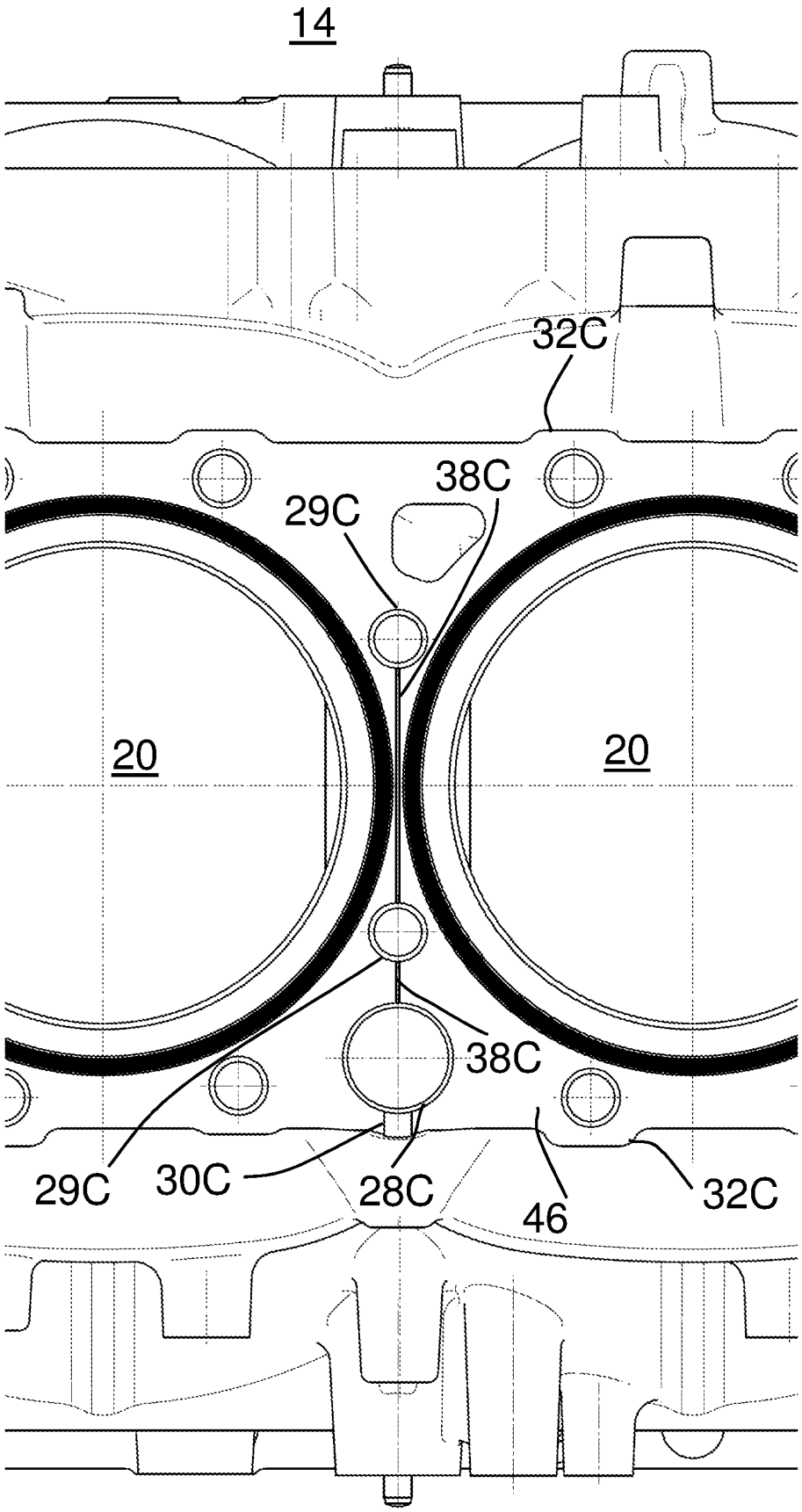
FIG. 6 shows a plan view of a region of an upper side of a crankcase.
Figure 7:
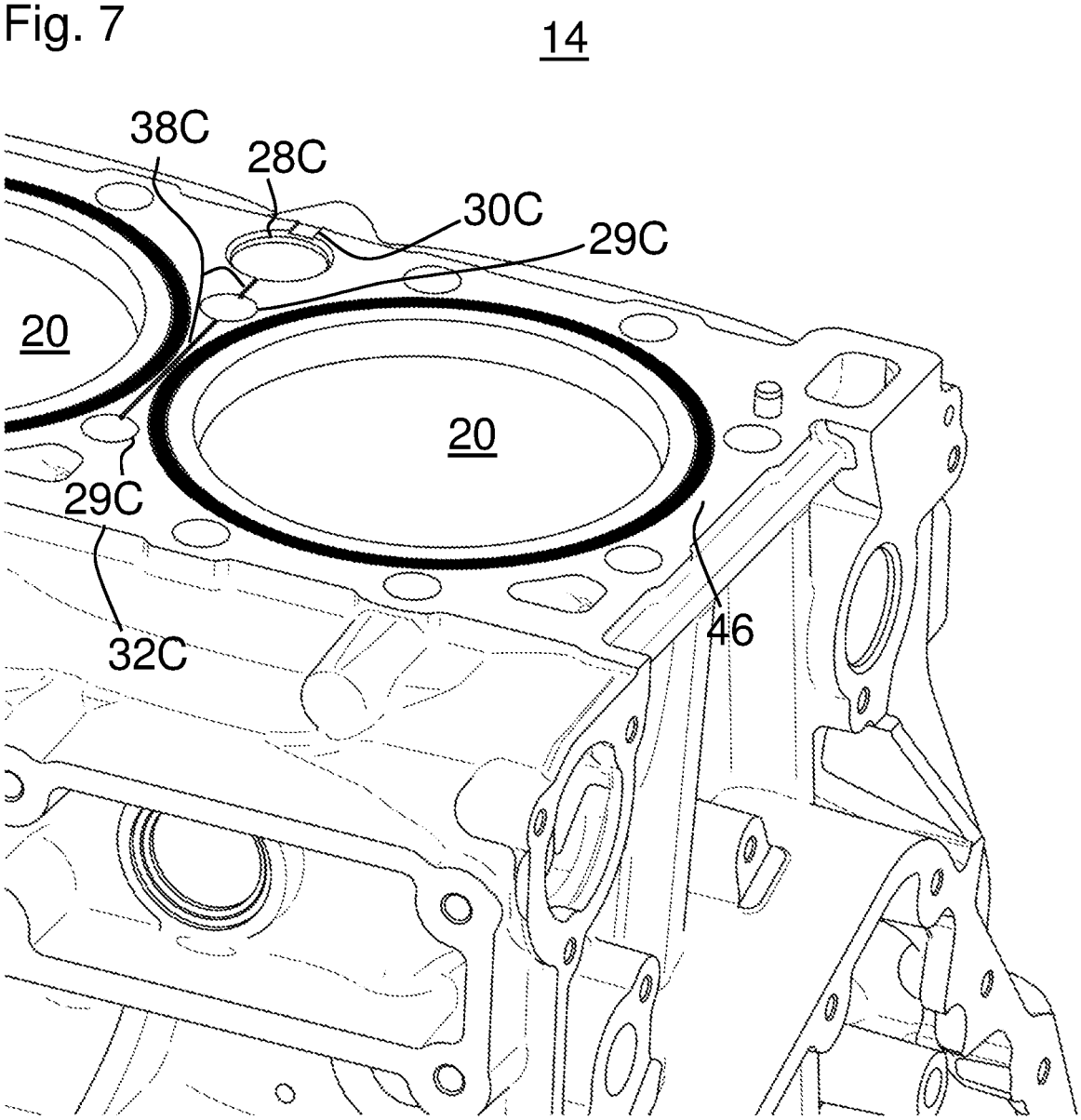
FIG. 7 shows a perspective view of a region of an upper side and of an outer periphery of a crankcase.

FIGS. 6 and 7 show different regions of a crankcase 14 from above. In the embodiment shown, a first leakage gas passage 30C extends between a first recess 28C and an outer peripheral surface 32C of the crankcase 14. Here, the first recess 28C is designed as a casting core hole, which is closed by a closure cap. Further leakage gas passages 38C extend between recesses 29C and recess 28C. Recesses 29C are here designed as screw holes for the reception of cap screws 13 (see FIG. 1). The leakage gas passages 30C, 38C are designed as depressions in the sealing surface 46. The sealing surface 46 surrounds the combustion chambers 20. The recesses 28C, 29C are arranged between adjacent combustion chambers 20. The crankcase 16 can furthermore have a ventilation passage of a crankcase ventilation system, which leads to a crank chamber ventilation system. In addition or as an alternative, existing leakage gas passages can open into the ventilation passage.

A person skilled in the art will recognize that the configuration and arrangement of the recesses and leakage gas passages in the above-described embodiments of the cylinder head gasket, of the cylinder head and of the crankcase can be analogous. In other words, all the features which are related to the recesses and leakage gas passages and are described herein with reference to the cylinder head gasket, the cylinder head or the crankcase can be provided in the same way on the respective other components.

As explained above, the leakage gas passages 30A, 30B, 30C, 38A, 38B, 38C make it possible to carry out a method for discharging leakage gas from at least one combustion chamber 20. Here, the method comprises collecting the leakage gas in at least one recess 28A, 28B, 28C, 29A, 29B, 29C, in particular a screw hole or a casting core hole, formed within the sealing region 18. By means of the leakage gas passages 30A, 30B, 30C, 38A, 38B, 38C, the accumulated leakage gas can then be discharged in a guided manner from the at least one recess 28A, 28B, 28C, 29A, 29B, 29C into an environment of the internal combustion engine 10 and/or into a ventilation system of the internal combustion engine 10.

The present disclosure is not restricted to the preferred illustrative embodiments described above. On the contrary, a large number of variants and modifications is possible, which likewise make use of the inventive concept and therefore fall within the scope of protection. In particular, the present disclosure also claims protection for the subject matter and features of the dependent claims, independently of the claims to which they refer.

LIST OF REFERENCE SIGNS

10 internal combustion engine
12 cylinder head
13 cap screw
14 crankcase
16 cylinder head gasket
18 sealing region
20 combustion chamber
22 cylinder liner
24 combustion chamber opening
26 sealing surface (cylinder head gasket)
28A recess (cylinder head gasket)
28B recess (cylinder head)
28C recess (crankcase)
29A recess (cylinder head gasket)
29B recess (cylinder head)
29C recess (crankcase)
30A leakage gas passage (cylinder head gasket)
30B leakage gas passage (cylinder head)
30C leakage gas passage (crankcase)
32A outer peripheral surface (cylinder head gasket)
32B outer peripheral surface (cylinder head)
32C outer peripheral surface (crankcase)
34 through hole
36 sealing surface (cylinder head gasket)
38A leakage gas passage (cylinder head gasket)
38B leakage gas passage (cylinder head)
38C leakage gas passage (crankcase)
39 leakage gas passage (cylinder head gasket)
40 combustion chamber surface
42B ventilation passage
44 sealing surface (cylinder head gasket)
46 sealing surface (crankcase)
50B casting core hole
52B closure cap

The invention claimed is:

1. An internal combustion engine for a motor vehicle, comprising:

a cylinder head;

a crankcase;

a cylinder head gasket, which is arranged between the cylinder head and the crankcase, wherein the cylinder head, the cylinder head gasket, and the crankcase form a sealing region for sealing at least one combustion chamber of the internal combustion engine;

a first recess, which is arranged within the sealing region and at a distance from the at least one combustion chamber; and a first leakage gas passage, which extends from the first recess to a first surface exposed to the environment of the internal combustion engine or to a ventilation passage of the internal combustion engine, wherein:

the first recess is provided in a sealing surface of the crankcase; or the first recess is provided in a sealing surface of the cylinder head.

2. The internal combustion engine according to claim 1, wherein the cylinder head is a single-cylinder cylinder head or a multi-cylinder cylinder head and the cylinder head gasket is a single-cylinder cylinder head gasket or a multi-cylinder cylinder head gasket.

3. The internal combustion engine according to claim 1, further comprising:

a second recess, which is arranged within the sealing region and at a distance from the at least one combustion chamber, wherein the second recess is a screw hole or a closed casting core hole; and a second leakage gas passage, which extends from the second recess to the first surface exposed to the environment of the internal combustion engine, to a second surface exposed to the environment of the internal combustion engine, to the first recess, to the first leakage gas passage and/or to the ventilation passage, wherein the second leakage gas passage is designed as a depression.

4. The internal combustion engine according to claim 3, wherein:

the first recess or the second recess is provided in a sealing surface of the cylinder head, in a sealing surface of the crankcase or in a sealing surface of the cylinder head gasket; or the first leakage gas passage or the second leakage gas passage is provided in a sealing surface of the cylinder head, in a sealing surface of the crankcase or in a sealing surface of the cylinder head gasket, wherein the first leakage gas passage or the second leakage gas passage is designed as a groove, a channel or a slot.

5. The internal combustion engine according to claim 1, wherein:

the first or the second surface exposed to the environment of the internal combustion engine is an outer peripheral surface of the cylinder head, an outer peripheral surface of the crankcase; or the ventilation passage forms a section of a cylinder head ventilation system and/or a section of a crank chamber ventilation system.

6. The internal combustion engine according to claim 3, wherein the at least one combustion chamber includes two adjacent combustion chambers, and the first recess or the second recess is arranged between the two adjacent combustion chambers.

7. The internal combustion engine according to claim 3, wherein:

the first leakage gas passage or the second leakage gas passage is formed by a forming method, a compressive forming method or stamping; or the first leakage gas passage or the second leakage gas passage is formed by a machining method or a milling method.

8. A cylinder head gasket, comprising:

at least one combustion chamber opening;

an outer peripheral surface;

a first sealing surface for sealing with respect to a crankcase or a cylinder head;

a first screw hole, which is arranged within the first sealing surface at a distance from the at least one combustion chamber opening; and a first leakage gas passage, which extends from the first screw hole to the outer peripheral surface or to a ventilation opening of the cylinder head gasket.

9. The cylinder head gasket of claim 8, wherein the gasket is formed for a single-cylinder cylinder head gasket or multi-cylinder cylinder head gasket of an internal combustion engine.

10. The cylinder head gasket according to claim 8, further comprising:

a second screw hole, arranged within the first sealing surface or a second sealing surface, which is opposite the first sealing surface, at a distance from the combustion chamber opening; and a second leakage gas passage, which extends from the second screw hole to the outer peripheral surface, to the first screw hole, to the first leakage gas passage or to a ventilation opening of the cylinder head gasket, wherein the second leakage gas passage is designed, as a depression which extends in the first sealing surface or the second sealing surface.

11. The cylinder head gasket according to claim 10, wherein the at least one combustion chamber opening has two adjacent combustion chamber openings, and the first screw hole or the second screw hole is arranged between the two adjacent combustion chamber openings.

12. The cylinder head gasket according to claim 10, wherein:

the cylinder head gasket is a single-ply cylinder head gasket, or the cylinder head gasket is a multi-ply cylinder head gasket and the first leakage gas passage or the second leakage gas passage extends in an outer ply of the multi-ply cylinder head gasket.

13. A cylinder head, comprising:

at least one combustion chamber surface for delimiting at least one combustion chamber;

an outer peripheral surface;

a sealing surface for sealing with respect to a cylinder head gasket;

a first recess, which is arranged within the sealing surface at a distance from the at least one combustion chamber surface, wherein the first recess is a screw hole or a closed casting core hole; and a first leakage gas passage, which extends from the first recess to the outer peripheral surface or to a ventilation passage of the cylinder head, wherein the first leakage gas passage is designed as a depression which extends in the sealing surface, and wherein the cylinder head is a single-cylinder cylinder head or multi-cylinder cylinder head for an internal combustion engine.

14. The cylinder head according to claim 13, wherein:

the at least one combustion chamber surface has two adjacent combustion chamber surfaces for two adjacent combustion chambers, and the first recess or a second recess is arranged between the two adjacent combustion chamber surfaces; or a second recess is arranged within the sealing surface at a distance from the at least one combustion chamber surface and is a screw hole or a closed casting core hole, and a second leakage gas passage is provided, which extends from the second recess to the outer peripheral surface, to the first recess, to the first leakage gas passage or to the ventilation passage, wherein the second leakage gas passage is designed as a depression which extends in the sealing surface.

15. A crankcase for an internal combustion engine comprising:

at least one combustion chamber;

an outer peripheral surface;

a sealing surface for sealing with respect to a cylinder head gasket;

a first recess, which is arranged within the sealing surface at a distance from the at least one combustion chamber, wherein the first recess is a screw hole or a closed casting hole; and a first leakage gas passage, which extends from the first recess to the outer peripheral surface or to a ventilation passage of the crankcase, wherein the first leakage gas passage is designed as a depression which extends in the sealing surface.

16. A motor vehicle or a commercial vehicle, comprising:

an internal combustion engine, including:

a cylinder head;

a crankcase;

a cylinder head gasket, which is arranged between the cylinder head and the crankcase, wherein the cylinder head, the cylinder head gasket and the crankcase form a sealing region for sealing at least one combustion chamber of the internal combustion engine;

a first recess, which is arranged within the sealing region and at a distance from the at least one combustion chamber; and a first leakage gas passage, which extends from the first recess to a first surface exposed to the environment of the internal combustion engine or to a ventilation passage of the internal combustion engine, wherein the first leakage gas passage is designed as a depression, wherein the crankcase further includes:

at least one combustion chamber surface for delimiting the least one combustion chamber;

an outer peripheral surface;

a crankcase sealing surface for sealing with respect to a cylinder head gasket;

a first recess, which is arranged within the crankcase sealing surface at a distance from the at least one combustion chamber surface, wherein the first recess is a screw hole or a closed casting core hole; and a first leakage gas passage, which extends from the first recess to the outer peripheral surface or to a ventilation passage of the cylinder head, wherein the first leakage gas passage is designed as a depression which extends in the crankcase sealing surface, and wherein the cylinder head is a single-cylinder cylinder head or multi-cylinder cylinder head for an internal combustion engine.

17. A method for discharging leakage gas or creeping gas, coming from a combustion chamber of an internal combustion engine from a sealing region between a cylinder head, a cylinder head gasket and a crankcase of the internal combustion engine for sealing the combustion chamber, comprising:

collecting the leakage gas in at least one recess formed within the sealing region; and guided discharging of the leakage gas out of the at least one recess outside the sealing region into an environment of the internal combustion engine or into a ventilation system of the internal combustion engine, wherein:

the at least one recess is provided in a sealing surface of the crankcase; or the at least one recess is provided in a sealing surface of the cylinder head.

18. The internal combustion engine according to claim 1, wherein the first leakage gas passage is designed as a depression.

19. The cylinder head gasket of claim 8, wherein the first leakage gas passage is designed as a depression which extends in the first sealing surface.

20. The crankcase of claim 15, wherein the first recess is a screw hole or a closed casting core hole.

21. The method of claim 17, wherein the collecting the leakage gas in at least one recess formed within the sealing region comprises collecting the leakage gas in at least one screw hole or casting core hole, which is at a distance from the combustion chamber of the internal combustion engine.

* * * * *